United States Patent [19]

Roberts

[11] Patent Number: 4,472,119

[45] Date of Patent: Sep. 18, 1984

[54] CAPACITY CONTROL FOR ROTARY COMPRESSOR

[75] Inventor: Richard W. Roberts, Lombard, Ill.

[73] Assignee: Borg-Warner Corporation, Chicago, Ill.

[21] Appl. No.: 509,639

[22] Filed: Jun. 30, 1983

[51] Int. Cl.[3] ..... F04C 18/00

[52] U.S. Cl. ..... 418/23; 418/24; 418/94

[58] Field of Search ..... 418/23, 24, 93, 94, 418/270, 115

[56] References Cited

U.S. PATENT DOCUMENTS

| | | | |
|---|---|---|---|
| 1,603,437 | 10/1926 | Wingquist . | |
| 2,175,413 | 10/1939 | Sharar | 192/58 |
| 2,696,790 | 12/1954 | Crow | 103/120 |
| 3,137,235 | 6/1964 | Brown | 103/4 |
| 3,153,384 | 10/1964 | Castel et al. | 103/120 |
| 3,180,271 | 4/1965 | Hartmann | 103/120 |
| 3,721,510 | 3/1973 | Gilbert | 418/115 |
| 3,904,327 | 9/1975 | Edwards et al. | 418/8 |
| 4,050,263 | 9/1977 | Adalbert et al. | 62/243 |
| 4,132,512 | 1/1979 | Roberts | 418/23 |

FOREIGN PATENT DOCUMENTS

| | | | |
|---|---|---|---|
| 2808208 | 8/1979 | Fed. Rep. of Germany | 418/23 |
| 2042642 | 9/1980 | United Kingdom | 418/23 |

*Primary Examiner*—Michael Koczo
*Assistant Examiner*—John J. McGlew, Jr.
*Attorney, Agent, or Firm*—Florian S. Gregorczyk

[57] ABSTRACT

A capacity control arrangement for a rotary vane fluid displacement apparatus, such as a rotary vane compressor, having a vane retaining means that may be moved to engage and retain the vanes in their retracted or nonworking position within the rotor defined guide slits. The retaining means are actuated to the vane-engaged position by hydraulic control fluid which is communicated to the retaining means in response to an external parameter sensed by a control means.

18 Claims, 16 Drawing Figures

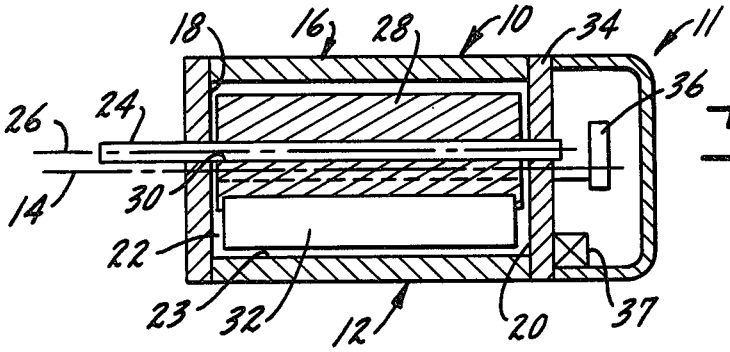
fig. 1.
fig. 2.
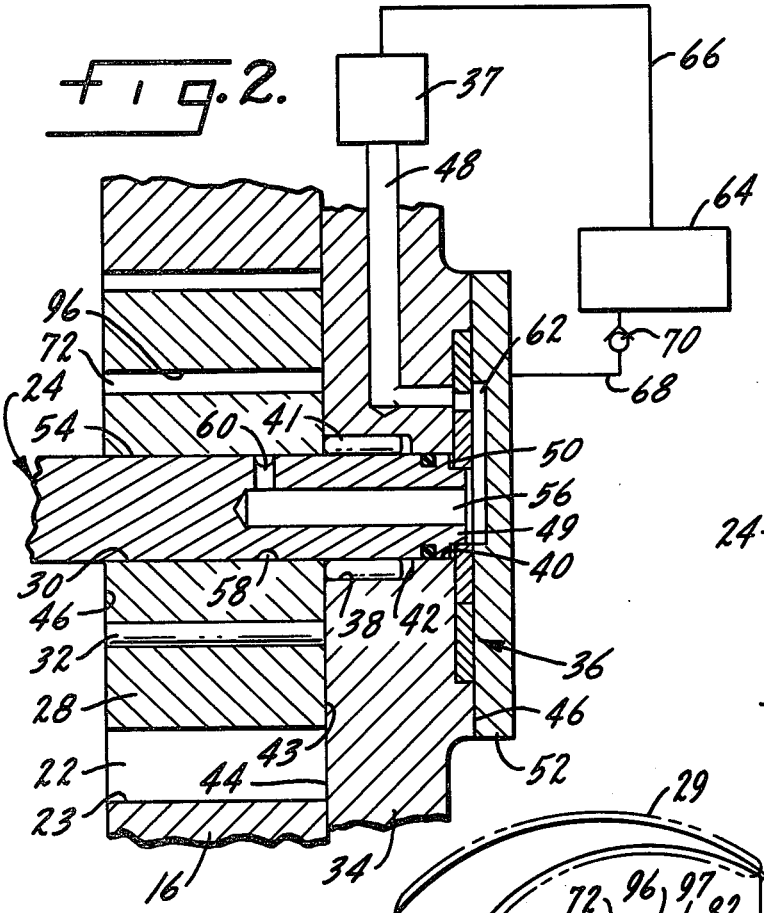
fig. 4.
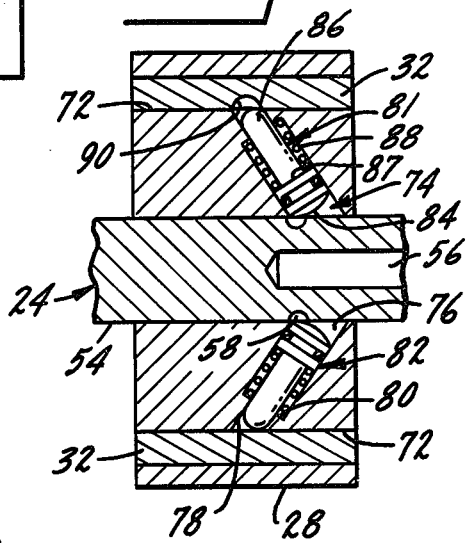
fig. 3.
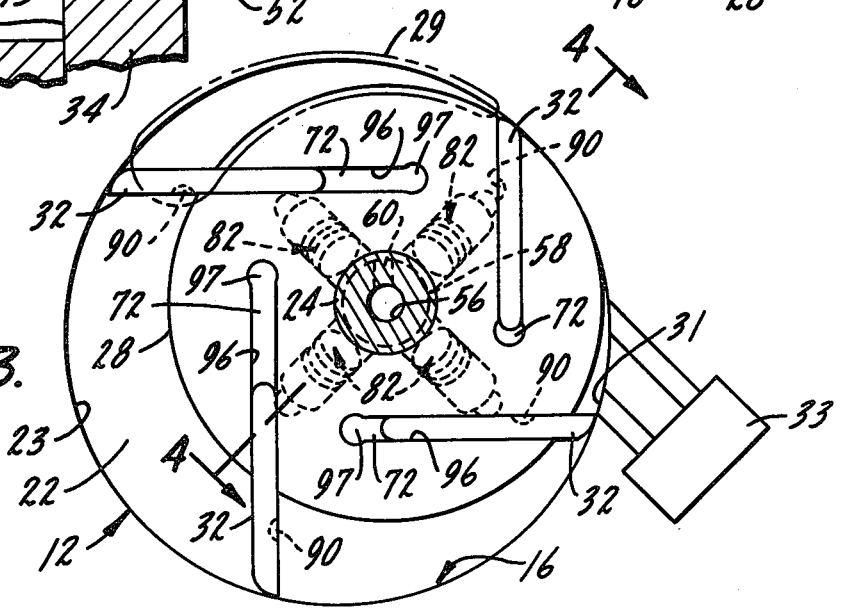

Fig. 5.
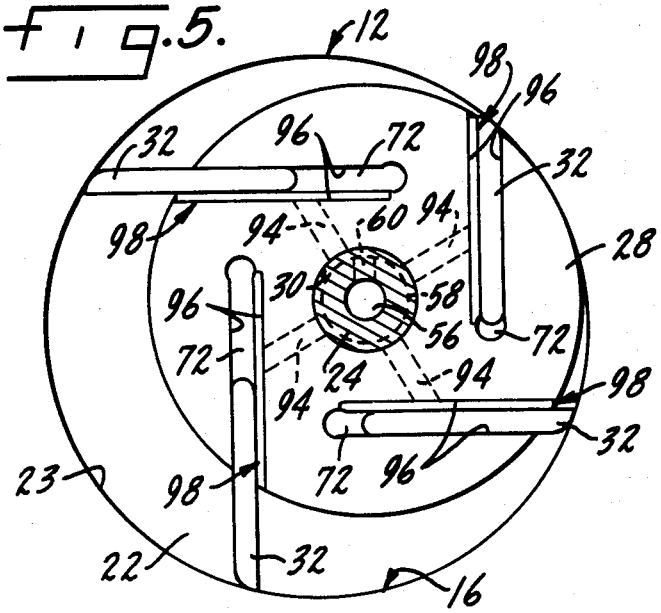
Fig. 6.
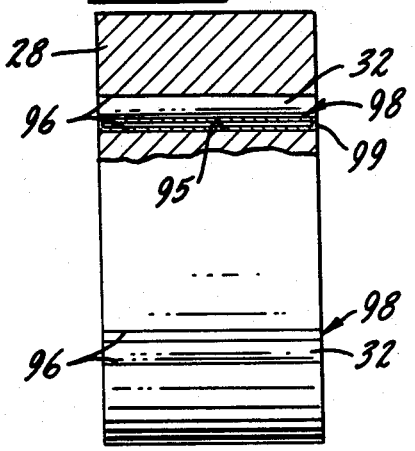
Fig. 7.
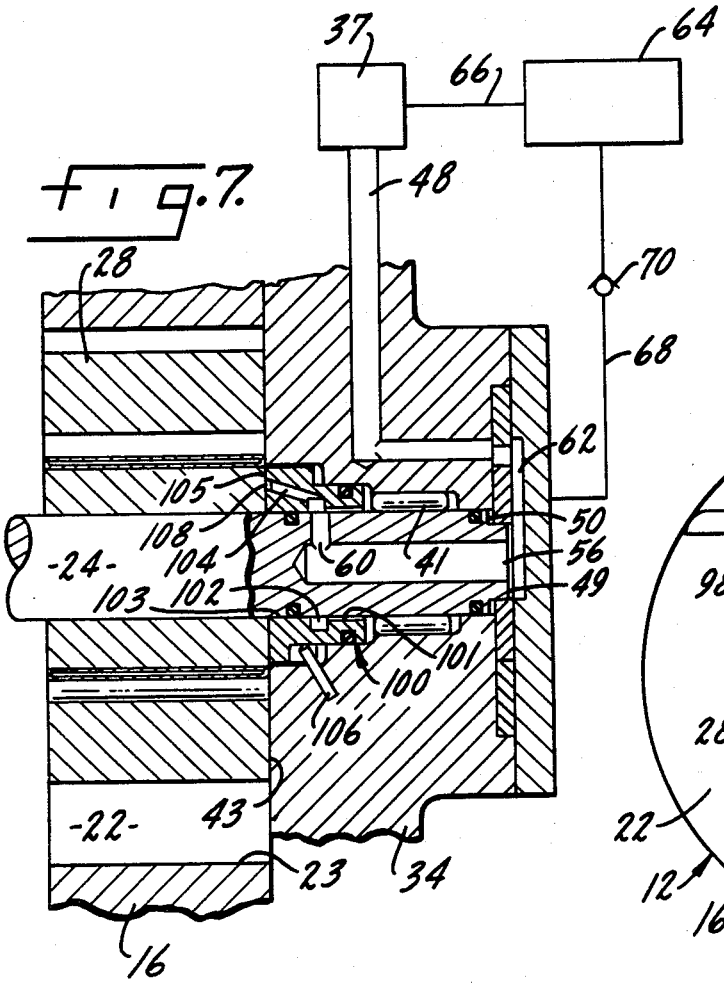
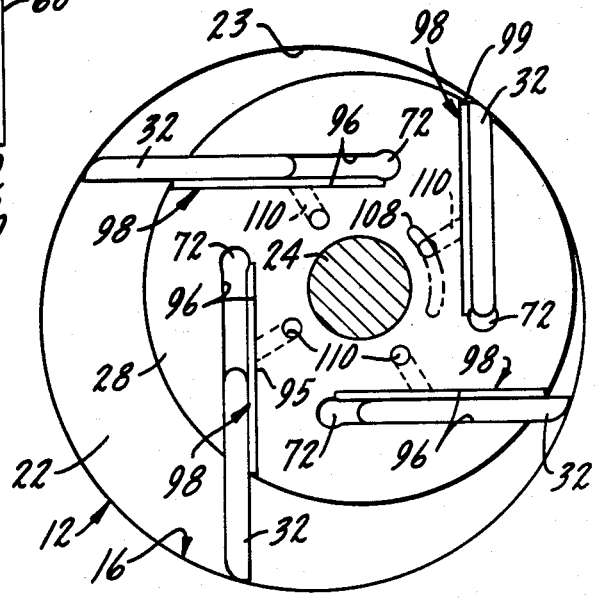
Fig. 8.

Fig. 13.
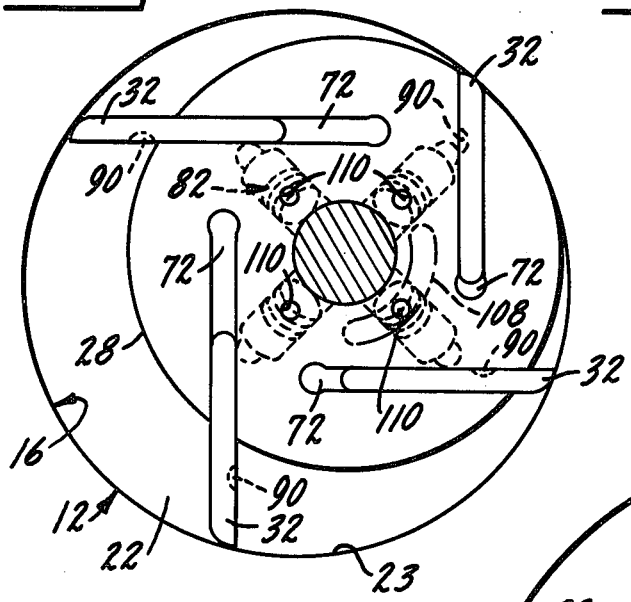
Fig. 14.
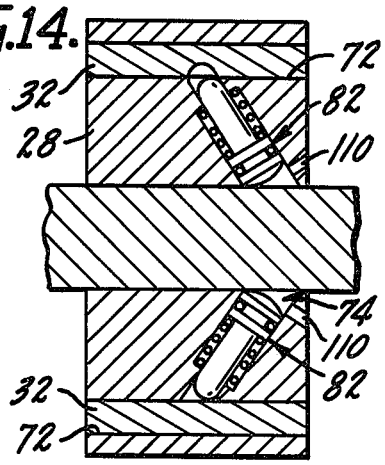
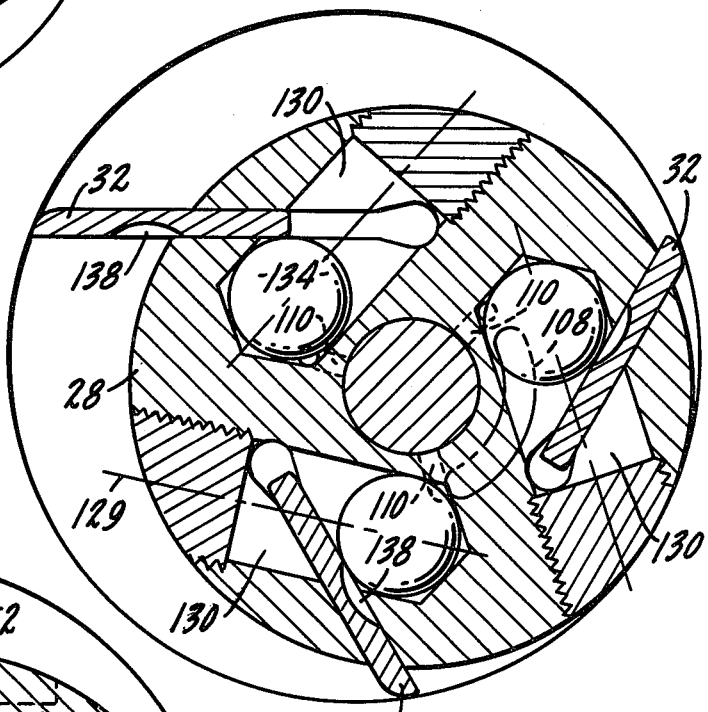
Fig. 15.
Fig. 16.
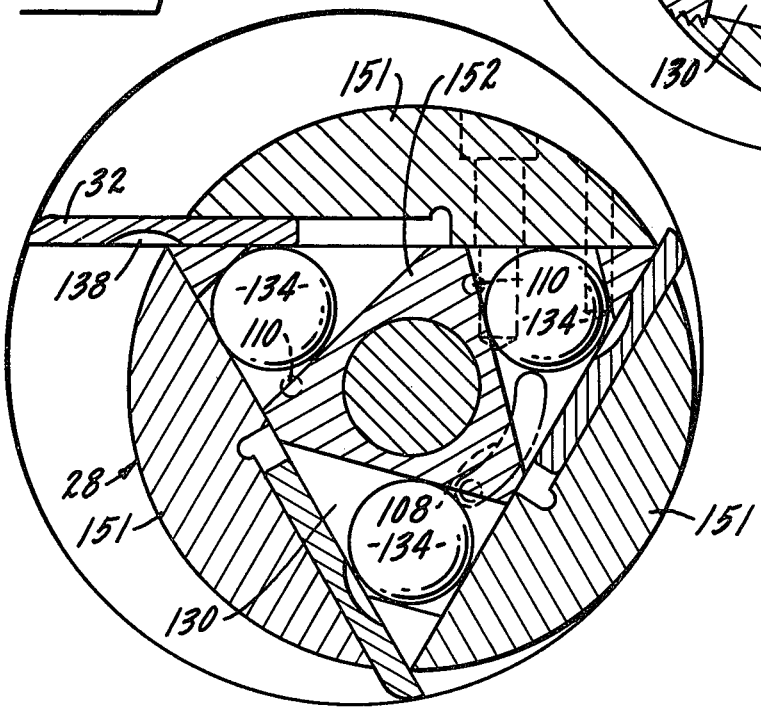

CAPACITY CONTROL FOR ROTARY COMPRESSOR

BACKGROUND OF THE INVENTION

1. Field

The invention relates generally to the control of a fluid displacement apparatus, by controlling the volume of fluid displaced or transmitted through such apparatus in response to an external parameter. More specifically, this invention relates to a rotary vane compressor frequently utilized for passenger compartment air conditioning on automobiles. In such compressors, retention of the vanes in their retracted position stops the pumping action. The present invention discloses a control circuit to provide for vane retention in the retracted position to modulate the compressor output in response to changing engine speeds, and cooling loads. It may replace the present clutch mechanism on an automotive air conditioning compressor for complete disengagement of the compressor from the driving means.

2. Prior Art

Control of the output or discharge from a compressor or rotary vane fluid displacement apparatus by control of the vanes has been demonstrated in the art. Methods usually employed to retain or retract these vanes utilize a mechanical clamping device, electromechanical device, control a clutch or use a regulator valve to control the discharge pressure. U.S. Pat. No. 2,696,790 (Crow) discloses a means to control radial movement of the blades from outside the pump utilizing an auxiliary source of hydraulic fluid and a manually operable cam mechanism. Cam mechanism rotation causes longitudinal movement of ring 27 to thus rotate pinions 30. Rotation of pins 30 adjusts rack 60 to control the outward movement of blades B. U.S. Pat. No. 2,175,413 (Sharar) teaches an hydraulic clutch with a slide or rod that is attached to two vanes and which slide is retractable to control the travel of the vanes through a pivot mechanism. An adjustable capacity vane pump is disclosed in U.S. Pat. No. 1,603,437 (S. G. Wingquist). The vanes and vane abutments are radially adjustable and the pump assembly itself comprises two vane pumps. The vanes 14 are actuated by springs 19 and the abutment vanes 20 are radially adjustable by the axial movement of slides 26 along the rotor axis. A continuous spring band to produce an outwardly biasing force on the vanes is taught in U.S. Pat. No. 3,904,327 (Edwards et al.), however, it does not teach vane retention. U.S. Pat. No. 3,137,235 (F. B. Brown) discloses a variable volume rotary pump which varies the pump delivery by moving a ring which defines the peripheral wall of the rotor chamber. U.S. Pat. No. 3,153,384 (Castel et al.) provides a vane type pump in which the vanes are continually pressurized radially at pump pressure, but the rotor chamber wall is shiftable to attain a no pumping capacity by moving pivot rings. In U.S. Pat. No. 3,180,271 (Hartmann) fluid pressure is utilized to hold the vanes extended and controls volume flow by movement of a port ring. This device utilizes both a governor 31 and a volume limit control 43. A means for retaining a pair of vanes in a compressor is illustrated in U.S. Pat. No. 4,050,263 (Adalbert et al.). In this disclosure a locking member engages a vane projection to retain the vanes in the retracted position. The locking member is axially movable along the rotor axis by an electromagnetic means. U.S. Pat. No. 4,132,512 (Roberts) teaches a means of vane retention utilizing a permanent magnet and a change of polarity therein to retain the vanes in the retracted position.

SUMMARY OF THE INVENTION

The invention encompasses fluid control means for a rotary vane fluid displacement apparatus to maintain the sliding vanes in a rotary compressor in their retracted position. Hydraulic fluid, in this case is also the source of compressor lubricant, is provided to move a retaining means to maintain the sliding vanes in their retracted position. Hydraulic fluid is provided through a control unit from a source such as a gerotor pump and the control unit monitors an external parameter to be responsive to a measurable quantity.

An automobile air-conditioner rotary vane compressor is operable at clutch engagement, however, it is desirable to eliminate the use of such clutch from a fuel economy as well as an original cost aspect. The present invention provides a means to reduce the fluid flow through such a rotary vane compressor and to eliminate the requirement and use of a clutch. The retention of the vanes in their guide slits essentially eliminates or totally mutes refrigerant fluid flow through such a compressor. In the embodiments of the present invention such a compressor would be operable in response to a measurable parameter such as evaporator pressure, engine speed or passenger compartment temperature.

In the compressor operating mode of the present invention the hydraulic fluid to provide actuation to the retaining means is interrupted and the retaining means withdraws to allow the vanes to again become radially extended, contact the pressure chamber wall and provide compression to a compressible fluid. At a predetermined engine speed, evaporator pressure or other measured operating parameter the control unit again provides communication to the retaining means to move them into engagement with the vanes to maintain the vanes in the withdrawn or nonworking position in the guide slits. When the vanes are in this withdrawn position fluid flow through such compressor is almost nil. Hydraulic fluid for retaining means actuation is provided by the same source supplying lubricating fluid for the air conditioning system and requires minimal power to actuate the retaining means.

BRIEF DESCRIPTION OF THE DRAWINGS

In the figures of the drawings like reference numerals identify like components and in the drawings:

FIG. 1 is a diagrammatic illustration of the parts relationship in a typical compressor structure;

FIG. 2 illustrates a cross-sectional view of a rotor and end plate assembly of a rotary vane assembly;

FIG. 3 is an end view of a rotor, housing and vane assembly with vane retaining means of a preferred embodiment;

FIG. 4 is a cross-sectional view of the rotor illustrating the retaining means along line 4—4 shown in FIG. 3;

FIG. 5 illustrates an end view of an alternative embodiment of a vane retaining means in a rotary vane apparatus;

FIG. 6 is a view in cross-section of the vane retaining means of FIG. 5;

FIG. 7 is a cross-sectional view of a rotary vane assembly of an alternative embodiment;

FIG. 8 is an end view of the alternative embodiment retaining means of FIG. 7;

FIG. 13 is an end view of a rotor, housing and vane assembly with a vane retaining means embodying an arcuate slot in the housing endplate;

FIG. 14 is a cross-sectional view of the rotor illustrating the retaining means shown in FIG. 13;

FIG. 15 is a cross-sectional end view of an alternative embodiment;

FIG. 16 is a cross-sectional end view of an alternative assembly of the embodiment shown in FIG. 15.

DETAILED DESCRIPTION OF THE INVENTION

Figure 9:
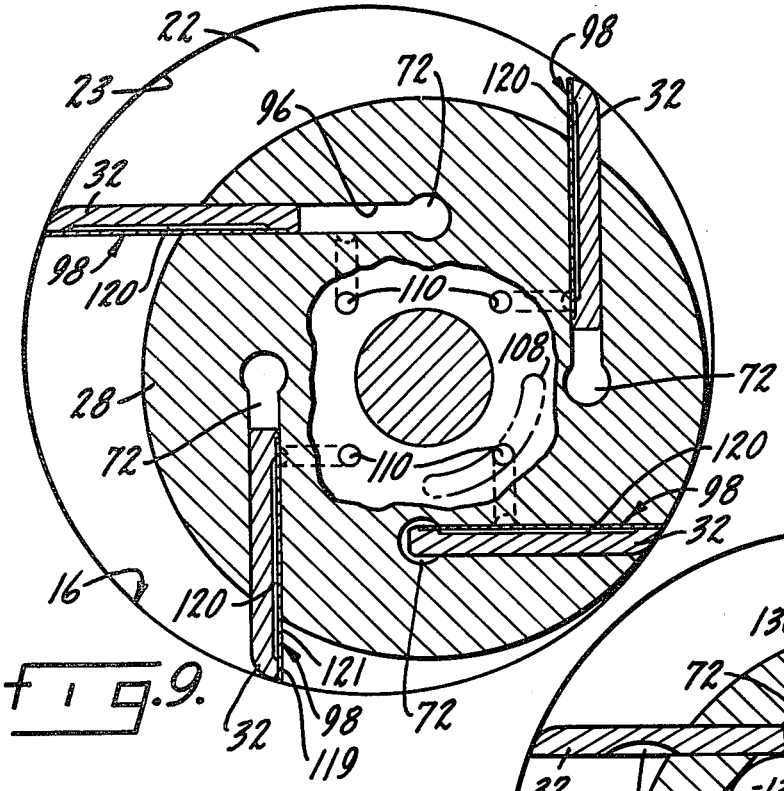
FIG. 9 is an end view in cross-section of a rotary vane assembly of an alternative embodiment.

Capacity control of a rotary vane fluid displacement apparatus 10 by use of a capacity control arrangement 11 is illustrated at FIG. 1.

The broad relationship of various parts of a rotary vane fluid displacement apparatus 10, such as an automotive air conditioning compressor are illustrated in FIG. 1 in a longitudinal relationship. Rotary vane apparatus 10 includes a cylindrical housing 12 with a longitudinal or reference axis 14, a wall 16, first end 18 and a second end 20 and an endplate 34 mountable on one of said ends 18 or 20, where wall 16, ends 18 and 20, and endplate 34 cooperate to define a compression chamber 22 with internal wall 23. A drive shaft 24 with longitudinal axis 26 extends through chamber 22 and second end 20 with its axis 26 parallel to but offset from housing axis 14. A rotor 28 defining a central through-bore 30 is mounted on shaft 24 in chamber 22. Rotor 28 includes a plurality of longitudinal slots and slidable vanes 32 operable in chamber 22. Endplate 34 is affixed to end 20 of housing 12 with shaft 24 extending therethrough and provides control fluid communication from a pump 36, such as a lubricating gerotor pump, to the endplate 34. A control means 37 is provided to communicate the control fluid from the endplate and relieve the fluid pressure from pump 36. Such capacity control with arrangement 11 by utilization of a pump 36 and control means 37 is attained by their cooperation with the following retaining means of a rotary vane apparatus 10.

FIG. 2 is a detailed cross-section of rotor 28, second end 20, endplate 34, pump 36 and shaft 24 in a preferred embodiment of the invention. Endplate 34 defines a centrally located first bore 38, a second bore 40 of a smaller diameter than first bore 38, a shoulder 42 at the junction of first bore 38 and second bore 40, a front face 43, a rear face 45, and a central fluid passage 48. Shaft 24 extends through bore 30 of rotor 28, first bore 38 and second bore 40 and has a bearing means 41 mounted on shaft 24 to be retained in first bore 38 when endplate front face 43 seals second end 20 of housing 12. Shaft 24 defines a protuberance 49 extending to pump 36. Protuberance 49 has a smaller diameter than shaft 24 and defines a drive shaft shoulder 50 between these larger and smaller shaft diameters. Pump 36, shown as a gerotor type pump, is mounted within endplate 34 to engage protuberance 49 and includes pump endplate 52.

Drive shaft 24 defines an outer wall 54, a blind-hole bore 56, and a cross-hole or cross-drilled passage 60. Apparatus 10 includes a means for selectively communicating hydraulic control fluid defining a fluid communication passage 58. Passage 58 is only illustrated in FIG. 2 as an annular groove defined by shaft 24. In FIG. 2 cross-hole 60 communicates between blind-hole bore 56 and passage 58, and shaft 24 has been utilized as the means to define passage 58.

Pump endplate 52 defines a passage 62 and blind-hole bore 56 is open at protuberance 49 to communicate between cross-hole 60 and passage 62 thereby providing fluid under pressure to blind-hole bore 56. Pump 36 communicates between conduit 62 and control fluid passage 48. Control means 37 may be a normally open control valve, such as a solenoid operated valve, to provide return flow from pump 36 to a sump 64 through a conduit 66 communicating between control means 37 and sump 64. Sump 64 communicates with pump 36 through a conduit means 68 having a check valve 70 therein to inhibit back flow to sump 64 through conduit 68.

Rotor 28 on shaft 24 in compression chamber 22 defines a first face 44, a second face 46, a fluid communication passage 58 for fluid communication from shaft cross-hole 60, and a plurality of longitudinal guide slits 72 with sidewalls 96 and a root 97 in proximity to shaft 24 as shown in FIG. 3. A plurality of slidable vanes 32, one in each of guide slits 72, are positioned to be reciprocable therein. Rotor 28 defines a plurality of piston bores or lateral passages 74 as shown in FIGS. 3 and 4, which bores 74 have a first diameter portion 76 and a second diameter portion 78 smaller than first diameter 76. Bores 74 define a shoulder 80 at the junction of first diameter 76 and second diameter 78. Bores 74 communicate between drive shaft annular groove 58 and guide slits 72. A plurality of retaining means 81 shown as pistons 82 are positioned in the plurality of piston bores 74. Each piston 82 defines a piston head 84 and a piston extension 86 of a smaller diameter than the piston head 84 with a shoulder 87 therebetween. Each piston 82 is slidable in its piston bore 74 and piston head 84 is matable with first bore diameter 76 and piston extension 86 is matable with second diameter 78. A plurality of bias springs 88, one for each piston 82, are mounted about piston extensions 86 in piston bores 74 between shoulders 80 and 87 to bias pistons 82 toward shaft 24. Each of the plurality of slidable vanes 32 define a detent 90 which is in register with its respective piston bore 74 when each vane 32 is at its furthest retracted position.

As shown in FIG. 3 for purpose of explanation is an inlet port 29 defined by endwall 16 and a discharge port 31 having a discharge valve assembly 33. Inlet port 29 provides access and communication to the compression chamber 22 for incoming compressible fluid in an air conditioner, and discharge port 31 and valve means 33 provide egress for a compressed fluid.

This preferred embodiment in FIG. 3 shows the fluid displacement apparatus 10 in the normal working mode. Slidable vanes 32 are extended from guide slits 72 to contact wall 16 and define segmented crescent-shaped cavities between vanes in compression chamber 22. Pump 36 draws fluid from sump 64 through conduit means 68 to passage 62, bore 56, cross-hole 60 and passage 58. In this normal working mode control means 37 communicates fluid to sump 64 through conduit 66. This open fluid communication provides a means to prevent a fluid pressure increase in bore 56 while maintaining fluid flow for lubrication to compression chamber 22. Actuation of control means 37 by a measured parameter, such as passenger-compartment temperature, evaporator pressure or engine speed, seals communication through central fluid passage 48 to thereby allow a fluid pressure increase to develop in bore 56.

A fluid pressure increase in bore 56 is communicated through cross-hole 60 and passage 58 to the plurality of piston bores 74. This control fluid under pressure acts on piston head 84 to move piston 82 against bias spring 88, and thus to move piston extensions 86 to engage slidable vanes 32. As rotor 28 rotates through a revolution each of the vanes are moved into the retracted or nonworking position. In this retracted position piston extension 86 contacts detent 90 of vane 32 to thereafter retain vanes 32 in the nonworking position when control means 37 is closed. When control means 37 is actuated to the open position fluid flow is again communicated to the sump 64, control fluid pressure in bore 56 is relieved and bias springs 88 move pistons 82 out of contact with vanes 32. Vanes 32 then extend themselves to contact wall 16 and are in the working position. Thus apparatus 10 is operable between a working or nonworking mode without use of a clutch means while only utilizing fluid control from a lubricating pump 36.

In an alternative embodiment illustrated in FIGS. 5 and 6 rotor 28 defines a plurality of lateral passages 94 communicating between through-bore 30 and longitudinal guide slits 72. Rotor 28 further defines a plurality of side walls 96 in guide slits 72 through which walls passage 94 provide communication. A flexible metal diaphragm 98 with a perimeter 99 is mounted in each slit 72 against wall 96 and over passage 94. As shown in a cutaway view in FIG. 6 diaphragm 98 with center portion 95 may be furnace brazed at its edges or perimeter 99 to side wall 96. To enhance this brazing process, such that a seal is provided at the perimeter 99 of diaphragm 98 while preventing a uniting of the diaphragm center to the sidewall, the diaphragm may be embossed or relieved at its central area.

In operation control means 37 again is closed to develop control fluid pressure which is communicated to passage 94 through bore 56, cross-hole 60 and passage 58. This control fluid pressure flexes diaphragm member 98 to contact sliding vane 32 and hold it against side wall 96. As rotor 28 continues to rotate through a cycle each vane 32 is mechanically driven or forced into its retracted or nonworking position and retained therein by expanded diaphragm 98. When control means 37 is again open the control fluid pressure is relieved below a predetermined value and the flexible diaphragm 98 relaxes to permit vanes 32 to extend to the working position in guide slits 72.

Another alternative embodiment is shown in FIGS. 7 and 8 where a face seal 100 with face 105 is mounted in endplate 34 to abut rotor 28. Seal 100 defines a longitudinal bore 101 with sidewall 103 through which shaft 24 extends, and further defines an annular groove or passage 102, similar to fluid communicating passage 58 of the embodiment disclosed in FIG. 3, and an oblique passage 104 communicating between groove 102 and rotor 28. Seal 100 is secured against rotation by a securing means 106. An arcuate slot or recess 108 is defined by face seal 100. Rotor 28 in this embodiment defines a plurality of lateral passages 110 communicating between guide slits 72 and arcuate slot 108 when rotor 28 rotates to bring each passage 110 in register with slot 108. The slot 108 and passages 110 are only in register when slidable vanes 32 are in their retracted or nonworking positions. Flexible diaphragms 98 with perimeter 99 and center portion 95 are again mounted on side walls 96 of guide slits 72 over passages 110. In this embodiment closure of control means 37 again provides a means to develop control fluid pressure in bore 56 which pressure is communicated to arcuate slot 108 through cross hole 60 and passage 104. As each guide slit 72 rotates past its point of closest contact with housing 12 vane 32 is in its retracted or nonworking position. Simultaneously passage 110 is in register with arcuate slot 108 to communicate fluid pressure to passage 110 to flex or expand diaphragm 98 against vane 32 and restrain it against sidewall 96. Each vane 32 is subsequently restrained against side wall 96 as it passes this minimal or tangential point between the housing 12 and rotor 28. This fluid pressure is retained in each passage 110 until control means 37 is again open to relieve the fluid pressure in lateral passage 110. The pressure is relieved in each lateral passage 110 as it comes into register with arcuate slot 108 to thus allow diaphragm 98 to relax, contract and allow the extension of vanes 32 to the working position. Such a timed relationship between the vanes and the application of hydraulic control fluid for vane retention prevents the vanes from being partially extended when in the retained mode. Partially extended vanes 32 could impact the compression chamber wall 16 with a resultant noise and potential impact damage.

Figure 10:
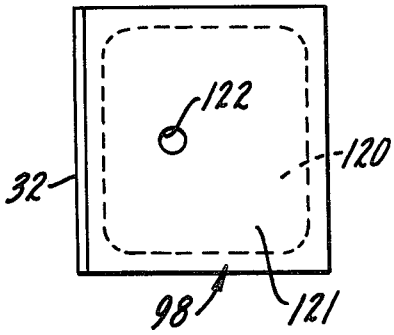
FIG. 10 is a plan view of a vane of the assembly shown in FIG. 9.

Diaphragms 98 of FIGS. 7 and 8 may be mounted on slidable vane 32. Such an embodiment is shown in FIGS. 9 and 10, where each vane 32 defines a vane face 119 and a cavity 120 inside the dashed line of FIG. 10 over which cavity 120 a flexible member or diaphragm 98 is sealingly brazed, soldered or joined to vane 32 to define an upper surface 121 of vane 32. Flexible diaphragm 98 defines a port 122 communicating to cavity 120 from surface 121. As vanes 32 reciprocate in guide slits 72 port 122 is brought into register with passage 110 when vanes 32 are fully retracted in guide slits 72. Hydraulic control fluid under pressure is communicated to cavity 120 through arcuate passage 108, passage 110 and port 122 to expand diaphragm 98 to contact sidewall 96 and retain vane 32 in the retracted or nonworking position. As in the earlier embodiments the hydraulic fluid pressure is retained in each passage until control means 37 is opened to relieve the fluid pressure in passage 110. Fluid pressure is relieved in each passage 110 as it comes into register with arcuate slot 108 to allow diaphragm 98 to relax. Vanes 32 then extend themselves to contact wall 16. This embodiment provides ease of assembly and improved economies.

Figure 11:
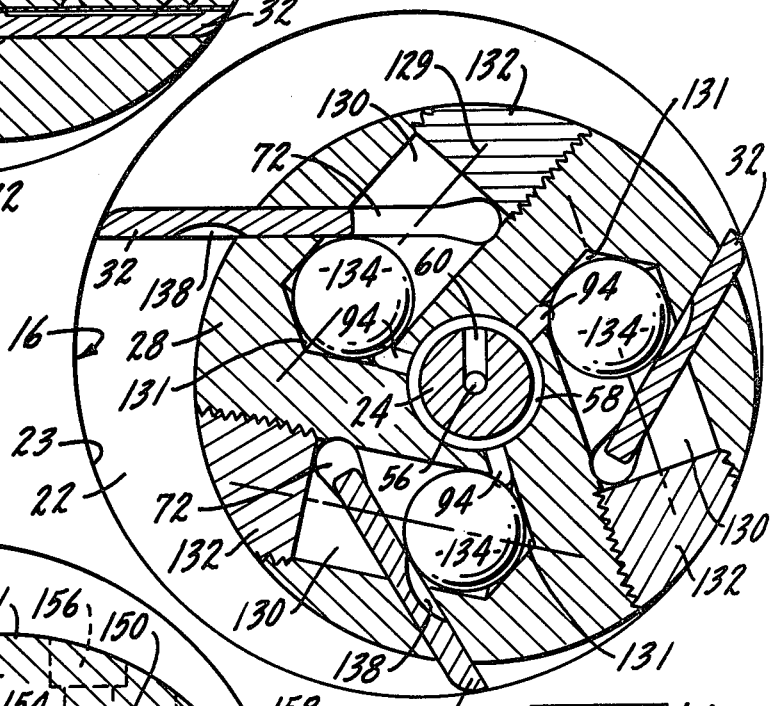
FIG. 11 is a cross-sectional end view of an alternative embodiment.
Figure 12:
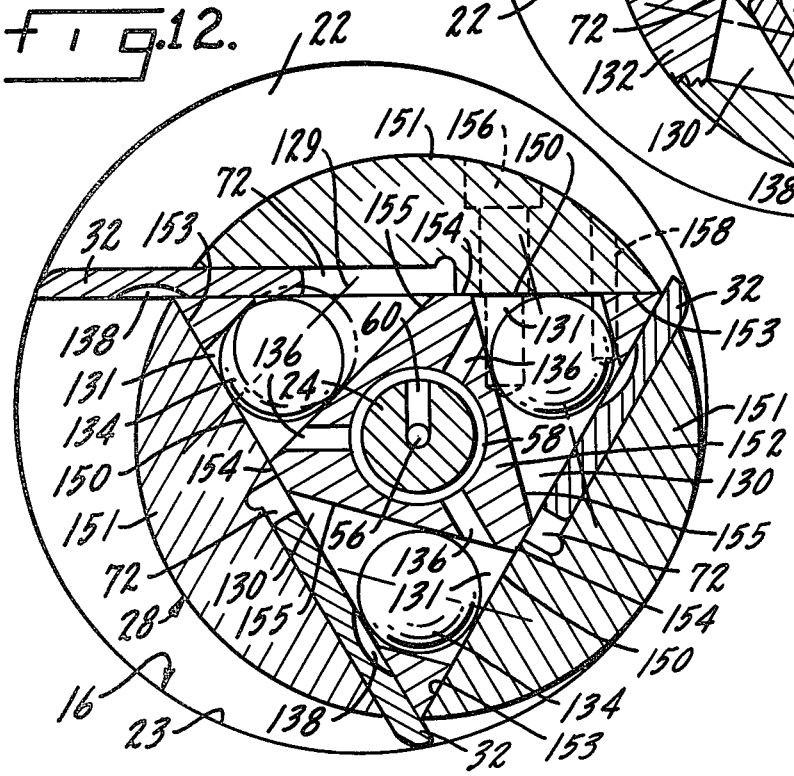
FIG. 12 is a cross-sectional end view of an alternative assembly of the embodiment shown in FIG. 11.

A further embodiment of the present invention utilizing hydraulic fluid pressure to actuate a vane retaining means is illustrated in FIGS. 11 and 12. In FIG. 11 rotor 28 defines a plurality of cylindrical blind-hole bores or cavities 130 with base 131. Bores 130 are sealed by plug means 132. Positioned in each bore 130 is a ball 134. Bores 130 with longitudinal axis 129 along a chord segment of a cross-section of roror 28 are oriented such that the rotational forces act to maintain ball 134 at base 131. As in FIGS. 2 and 3 drive shaft 24 defines blind-hole bore 56, cross-hole 60 and annulus 58. Rotor 28 defines lateral fluid passages 94 communicating between passage 58 and base 131 of bores 130. Vanes 32 are operable in guide slits 72 and define a detent 138 in each vane 32. Guide slits 72 project through bores 130 at an acute angle and vanes 32 are positioned therein such that detents 138 are in register with bore 130 when vanes 32 are fully retracted. Such bore and detent registry allows balls 134 to engage detents 138 when fluid pressure is provided at bore base 131 from shaft blind-hole bore 56 by the closure of control means 37.

A structure similar to that of FIG. 11 for vane retaining means is illustrated in FIG. 12. However, rotor 28 is shown as an assembly of circular segments 151 with substantially flat surfaces 153 on circle chords 150 which may be machined separately and assembled about a generally triangular-shaped core or element 152 with generally flat surfaces 155 and corners 154 mounted on shaft 24. The generally flat surfaces of segments 151 and 155 are easy to machine and assemble, but cooperate to define the vane slots 72. Balls 134, operable as retaining means 81, are positioned in bores 130 to contact detents 138 when fluid pressure is introduced through bore 56 and passage 94 to bore base 131. The chordal segments 150 are assembled together and secured to rotor core 152 by screws 156, and dowels 158. These screws 156 and dowels 158 are ground flush with the rotor 28 surface after assembly. Any other securing means known in the art may be utilized to secure these rotor segments.

FIGS. 13 and 14 generally embody the structure of the vane retaining means of FIGS. 3 and 4 in cooperation with the control fluid transfer means of FIG. 7. In these embodiments rotor 28 defines lateral passages 110 for each piston 82 which communicate between arcuate slot 108 in seal face 105 and piston bore 74 when passage 110 and arcuate slot 108 are in register. Each passage 110 is in register with slot 108 when the vanes are in their retained or nonworking mode. When control fluid under pressure is communicated through passage 110 to a piston bore 74 the piston 82 is moved to engage detents 90 and thereby retain vanes 32 in guide slits 72. The vanes 32 may resume a working mode by the release of the control fluid pressure on pistons 82 in piston bores 74, which pressure is relieved by relief of the pressure in arcuate slot 108 when passages 110 again come into register with slot 108.

Similarly, the vane retaining means disclosed in FIGS. 11 and 12 are operable by control fluid transfer means as in FIG. 7. In these structures illustrated at FIGS. 15 and 16, rotors 28 define lateral passage 110. As each of the passages 110 come into register with arcuate slot 108 control fluid may be communicated to or from bores 130. Passages 110 and slot 108 are in register when the vanes 32 defining detents 138 are in their retracted position. In this retracted position balls 134 are movable to engage detents 138 when control fluid is communicated to bores 130. Vanes 32 are then maintained in the retracted position until fluid pressure below a predetermined value in bores 130 is relieved through passage 110 and slot 108.

Those skilled in the art will recognize that certain variations can be made in the illustrated embodiments. While only specific embodiments of the invention have been described and shown, it is apparent that various alterations and modifications can be made therein. It is, therefore, the intention in the appended claims to cover all such modifications and alternations as may fall within the true scope and spirit of the invention.

I claim:

1. A capacity control arrangement for a rotary vane fluid displacement apparatus which apparatus includes a housing having a reference axis, at least one endplate affixed to said housing to define therewith a compression chamber having an internal wall, a shaft extending through said housing and having an axis parallel to the reference axis, said shaft having an outer wall and defining a blind-hole bore, said shaft further defining a cross-drilled passage communicating between said blind-hole bore and said outer wall, a rotor mounted on said shaft in said compression chamber, said rotor defining a first face, a second face and a plurality of longitudinal guide slits, each slit having side walls and a root in proximity to said shaft, a plurality of slidable vanes respectively disposed in said guide slits, each vane being operable between an extended working position and a retracted nonworking position, an inlet port and a discharge valve means connected to provide ingress to and egress from said compression chamber for a compressible fluid, a control means, and means for selectively communicating a hydraulic control fluid through said blind-hole bore in response to said control means, wherein said fluid displacement apparatus includes a means defining a fluid communication passage open to fluid communication from said cross-drilled passage and said rotor defines a plurality of lateral passages, each lateral passage communicating between said fluid communicating passage and one of said guide slits, and said rotor includes retaining means operable by said hydraulic control fluid to retain said vanes in their retracted position.

2. A capacity control arrangement as claimed in claim 1 wherein said means defining said fluid communication passage is said shaft.

3. A capacity control arrangement as claimed in claim 2, wherein said retaining means includes each vane defining a detent, said detent being in register with said lateral passage at said vane retracted nonworking position, and a piston positioned and movable in each of said lateral passages to engage said detent to thereby retain said vane in the retracted position in response to said control means.

4. A capacity control arrangement as claimed in claim 3, wherein each of said lateral passage in the rotor defines a first diameter portion and a second diameter portion smaller than said first diameter portion, and a shoulder between said first and second diameter portions, said movable piston defining a piston head and a piston extension with a shoulder therebetween, which piston head has a larger diameter than an extension diameter, said piston head and extension diameters being matable with said lateral passage first diameter and second diameter portions, respectively, and a bias spring positioned in said lateral passage to contact said passage shoulder and said piston shoulder to thereby maintain said piston in said lateral passage and out of contact with said vane detent.

5. A capacity control arrangement as claimed in claim 2, wherein said retaining means includes a flexible metallic diaphragm defining a given perimeter and a center portion, a diaphragm positioned in each of said guide slits and affixed to its respective guide slit side wall at said perimeter, said diaphragm covering said rotor-defined lateral passage and said center portion is expandable in response to hydraulic control fluid to engage said vane.

6. A capacity control arrangement as claimed in claim 2, wherein said rotor defines a cavity for and communicating with each of said guide slits, each cavity having a free rolling ball therein, which cavity communicates with said lateral passage for each of said guide slits, each vane defining a detent wholly included within its associated cavity at said vane retracted position, said ball being operable to engage said detent of said vane by the communication of hydraulic fluid under pressure in response to said control means through said associated lateral passage and said drive shaft blind-hole bore.

7. A capacity control arrangement as claimed in claim 6 wherein each of said cavities contains a free-sliding ball oriented to disengage said ball from contact with said vane in response to rotational force of said rotor at the reduction of said hydraulic fluid pressure below a predetermined value.

8. A capacity control arrangement as claimed in claim 6 wherein said rotor-defined cavity is a cylindrical blind-hole bore whose longitudinal axis lies along a chord of a cross-section of said cylindrical rotor.

9. A capacity control arrangement as claimed in claim 6 wherein said rotor defining said cavities is comprised of the assemblage of a central element with a longitudinal cross-section of a triangular shape;

three rotor segments with a cross-section of an arc chord segment positioned such that the corners of said triangular shape contact the chord of said chord segment and which chords intersect and cooperate with said central element to define the rotor, guide slits, and cavities wherein the ball retaining means is operable in response to a hydraulic control fluid to engage and retain said vanes in said guide slits, and which triangular shaped element is mounted on said shaft and defines said lateral passages communicating to said cavities wherein said ball is operable.

10. A capacity control arrangement as claimed in claim 1 and further comprising a face seal defining a longitudinal bore with a side wall is mounted and retained on said shaft in a fixed position, said face seal defining a face abutting the rotor and defining an arcuate recess therein, wherein said means defining said fluid communication passage is said face seal which means is an annular passage in said side wall of said longitudinal bore in register with said shaft cross-drilled passage, thereby providing hydraulic control fluid communication to said arcuate recess and to said retaining means only when said lateral passage to each guide slit is in register with said arcuate recess.

11. A capacity control arrangement as claimed in claim 10 wherein said retaining means includes a flexible metallic diaphragm with a given perimeter and a center portion positioned in each of said guide slits and affixed to its respective guide slit side wall at said perimeter, said diaphragm covering said lateral passage and said center portion being expandable in response to hydraulic control fluid to engage said vane.

12. A capacity control arrangement as claimed in claim 10 wherein said face seal arcuate recess is oriented to provide fluid flow communication from said lateral passage only at said vane retracted position.

13. A capacity control arrangement as claimed in claim 10 wherein each of said vanes defines a vane face in proximity to said lateral passage communicating to said guide slit and further defines a cavity in said vane face, a flexible metallic diaphragm mounted on each of said vane faces over said vane face cavity;

each of said diaphragms defining a port communicating to said cavity;

each of said ports being in registry with said lateral passage when said vanes are in said retracted position.

14. A capacity control arrangement as claimed in claim 13 wherein hydraulic control fluid is communicated from said lateral passage through said diaphragm to said vane cavity from said arcuate recess to expand said diaphragm in said guide slit against said guide slit wall and frictionally retain said vane within said slit at the closure of said control means for selectively communicating control fluid.

15. A capacity control arrangement as claimed in claim 10, wherein said rotor defines a cavity for and communicating with each of said guide slits, each cavity having a free rolling ball therein, which cavity communicates with said lateral passage for each of said guide slits, each vane defining a detent wholly included within its associated cavity at said vane retracted position, said ball being operable to engage said detent of said vane by the communication of hydraulic fluid in response to said control means through said associated lateral passage said arcuate recess and said drive shaft blind-hole bore.

16. A capacity control arrangement as claimed in claim 15, wherein each of said cavities contain a free-sliding ball oriented to disengage said ball from contact with said vane in response to rotational force of said rotor at the reduction of pressure of said hydraulic fluid.

17. A capacity control arrangement as claimed in claim 15 wherein said rotor-defined cavity is a cylindrical blind-hole bore having longitudinal axis which lies along a chord of a cross-section of said cylindrical rotor.

18. A capacity control arrangement as claimed in claim 15 wherein said rotor defining said cavities is comprised of the assemblage of a central element with a longitudinal cross-sectional of a triangular shape;

three rotor segments with a cross-section of an arc chord segment positioned such that the corners of said triangular shape contact the chord of said chord segment and which chords intersect and cooperate with said central element to define the rotor, guide slits, and cavities wherein the ball retaining means is operable in response to a hydraulic control fluid to engage and retain said vanes in said guide slits, and which triangular shaped element is mounted on said shaft and defines said lateral passages communicating to said ball-retaining cavities.

* * * * *